US005998981A

United States Patent [19]

Houghton et al.

[11] Patent Number: 5,998,981

[45] Date of Patent: Dec. 7, 1999

[54] WEAK INVERSION NMOS REGULATOR WITH BOOSTED GATE

[75] Inventors: Russell J. Houghton, Essex Junction; Richard M. Parent, Shelburne; Adam B. Wilson, South Burlington, all of Vt.

[73] Assignee: International Business Machines Corporation, Armonk, N.Y.

[21] Appl. No.: 08/868,089

[22] Filed: Jun. 3, 1997

[51] Int. Cl.[6] ..... G05F 1/56

[52] U.S. Cl. ..... 323/282

[58] Field of Search ..... 323/266, 270, 323/273, 274, 282, 284

[56] References Cited

U.S. PATENT DOCUMENTS

| | | | |
|---|---|---|---|
| 4,952,863 | 8/1990 | Sartwell et al. . | |
| 5,406,192 | 4/1995 | Vinciarelli | 323/284 |
| 5,528,125 | 6/1996 | Marshall et al. | 323/222 |
| 5,883,505 | 3/1999 | Magazzu et al. | 323/282 |
| 5,929,614 | 7/1999 | Copple | 323/282 |

*Primary Examiner*—Matthew Nguyen

*Attorney, Agent, or Firm*—DeLio & Peterson, LLC; Peter W. Peterson; Robert A. Walsh

[57] ABSTRACT

A voltage regulator for DRAM chips having known short duration high current load events started by a trigger signal includes a regulating transistor operating in the weak inversion mode and a boost driver circuit. The trigger signal that starts the load event also triggers the boost driver circuit to produce a shaped boost signal at the correct time. The boost signal is applied to the gate of the regulating transistor to counteract the expected voltage drop at the output of the regulating transistor. The expected voltage drop is due to the known characteristics of the regulating transistor which include a change in threshold voltage of the regulating transistor during the high current flow of the load event. A switch device disconnects a preregulator during the load event and reconnects the preregulator thereafter. The boost signal is preferably applied to the regulating transistor through a capacitive divider.

20 Claims, 3 Drawing Sheets

WEAK INVERSION NMOS REGULATOR WITH BOOSTED GATE

BACKGROUND OF THE INVENTION

1. Technical Field

This invention relates to voltage regulators for integrated semiconductor circuits. More particularly, the invention relates to voltage regulators that supply load current during a load event where the load current during the load event is approximately known before the event occurs.

2. Description of Related Art

Dynamic random access memory (DRAM) chips commonly use large NMOS regulating transistors operated in the weak inversion mode to generate internal voltages. Some advantages of this type of voltage regulator are the wide external voltage operating range, the simplicity of design and the relatively low operating current.

In a typical design, a static bias voltage is generated by an oscillator/pump preregulator. The preregulator provides a relatively constant static bias voltage equal to the desired voltage regulator output voltage plus the threshold voltage of the NMOS regulating transistor. The static bias voltage is applied to the gate of the NMOS regulating transistor operating in the weak inversion mode. This generates the desired regulated output voltage at the source lead of the NMOS regulating transistor.

In order to generate a stable ripple free output, the static bias voltage must be held constant, and generally this is accomplished through the use of a relatively large gate capacitor located between the NMOS regulating transistor gate lead and ground.

One problem with this design is that the gate to source threshold voltage $V_t$ varies somewhat depending upon the current through the NMOS regulating transistor.

In a DRAM chip the load current varies from a relatively low standby current $I_{STBY}$ to a peak load current $I_{PEAK}$ which may be up to six orders of magnitude greater than the standby current. When prior art regulators are used in this application, the described fluctuation in threshold voltage as a function of load current appears as a fluctuation in the regulated output voltage. This fluctuation can cause problems with some circuits, particularly chip input receivers. Also, if the ratio between peak to average load current is high, for example in the set current of a DRAM array, worse voltage fluctuation results as the peak current $I_{PEAK}$ moves further into the NMOS overdrive region.

One approach to this problem would be to use feedback from the regulated voltage output of the voltage regulator to correct the input voltage at the gate of the regulating transistor. This would require a drive regulator circuit to detect that the output voltage was dropping as load current increased, which could then boost the voltage at the gate of the regulating transistor. However, in view of the high speed operation in modern DRAMs, this type of feedback would require a nearly perfect drive regulator feedback circuit providing nearly infinite gain and bandwidth. Otherwise, the boost in voltage at the gate of the regulating transistor would come too late to counteract the drop in voltage at the output.

In view of the absence of perfect feedback circuits of the type needed, this type of feedback method is not practical. However in certain applications, the current drawn by the load $I_{LOAD}$ is highly predictable. This is particularly true in the case of DRAM memory chips, where the shape of the load current curve is often known quite accurately. Typically the load current starts at a low standby current, then increases rapidly to a peak current value and then falls back to standby. This pulse of current during the load event occurs over a well defined time period.

For loads of this type, i.e. which have an approximately known load current characteristic shape during the load event, the boost voltage that would be produced by a fictitious perfect feedback circuit can be predicted in advance. This is possible by combining knowledge of the predicted load current with knowledge about the measured voltage drop characteristic of the NMOS regulating transistor as a function of load current.

Using this prediction, the necessary boost voltage from a perfect feedback circuit can be determined in advance. This allows an appropriate boost driver circuit to be built which is triggered by the same signal that starts the known load event. The boost driver circuit produces a shaped boost signal, which is then applied to the input of the regulating transistor and which completely or nearly completely counteracts the drop in output voltage that would otherwise have occurred.

Bearing in mind the problems and deficiencies of the prior art, it is therefore an object of the present invention to provide a voltage regulator with reduced voltage fluctuation at its output during a short duration load event.

Yet another object of the invention is to provide a voltage regulator suitable for use in DRAM chips using large NMOS devices operating in the weak inversion mode to generate internal voltages with reduced voltage fluctuations.

A further object of the invention is to provide a voltage regulator for supplying load current during a load vent to a load having an approximately known load current characteristic during the load event wherein a boost driver circuit is used to simulate the output of an idealized perfect feedback circuit to boost the input voltage of the feedback transistor during the load event.

Still other objects and advantages of the invention will in part be obvious and will in part be apparent from the specification.

SUMMARY OF THE INVENTION

The aforementioned objects and advantages are achieved in the present invention which relates in one aspect to a voltage regulator for supplying load current during a load event to a load having an approximately known load current characteristic during the load event. The voltage regulator includes a voltage supply terminal for connection to a supply voltage and a regulating transistor for supplying the load current during the load event from the voltage supply terminal to the load. The regulating transistor includes a control lead, an output for supplying the load current at a regulated voltage and has a known voltage drop characteristic for supplied load currents.

A preregulator supplies a constant voltage to the control lead of the regulating transistor and a boost driver circuit produces a shaped boost signal to a point between the preregulator and the control lead of the regulating transistor. The boost driver circuit is responsive to a trigger signal associated with the load event and applied at its input to produce the boost signal.

The shape of the boost signal is predetermined according to the approximately known load current characteristic of the load and the known voltage drop characteristic of the regulating transistor. This shape corrects or boosts the voltage at the control lead of the regulating transistor just enough to compensate for the voltage change at the regulated voltage output of the regulating transistor due to the increased load current.

In another aspect of the invention, the voltage regulator is provided with a switch device serially connected between the preregulator and the control lead of the regulating transistor. The switch device has a control lead through which it is turned off during the load event via a second output from the boost driver circuit. When turned off, the switch device isolates the boost circuit and regulating transistor from the preregulator.

In yet another aspect of the invention, the boost driver circuit includes a pulse shaping circuit connected between the one shot circuit and the first output to shape the boost signal. The pulse shaping circuit includes a skewed inverter serially connected between a one shot circuit and the output of the boost driver circuit which feeds the control lead of the regulating transistor.

In still another aspect of the invention, the boost signal is applied to the control lead of the regulating transistor through a capacitive voltage divider having a first capacitor serially connected between the output of the boost driver circuit and the control lead of the regulating transistor, and a second capacitor connected to the control lead of the regulating transistor. In the preferred design, the first capacitor has a lower capacitance than the capacitance of the second capacitor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–5 of the drawings in which like numerals refer to like features of the invention.

Figure 1:
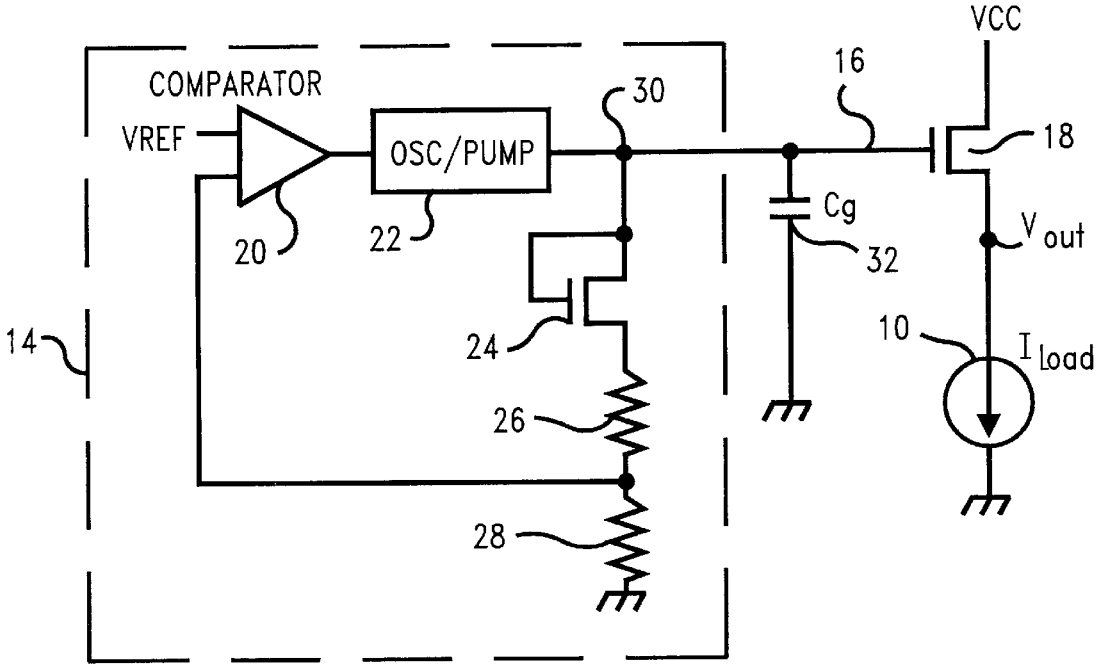
FIG. 1 (Prior Art)
FIG. 1 is a circuit diagram of a prior art voltage regulator.

FIG. 1 provides a circuit diagram of a prior art voltage regulator typically used to provide a regulated voltage $V_{OUT}$ to a load 10 drawing load current $I_{LOAD}$ during a load event. Such regulators are commonly used in high speed dynamic random access memory systems where the load event involves rapidly charging a large capacitive load during a relatively short period of time with a peak current $I_{PEAK}$ and operating at low power and low standby current $I_{STBY}$ at other times. The typical load current $I_{LOAD}$ plotted as a function of time during a load event may be seen in FIG. 4 indicated with reference numeral 12.

Referring back to FIG. 1, the prior art voltage regulator comprises a preregulator, generally indicated with reference numeral 14, connected to the control lead 16 of a regulating transistor 18. The regulating transistor 18 is connected between voltage supply VCC and load 10. The preregulator 14 comprises a comparator 20, having one input connected to a reference voltage VREF, an oscillator/pump 22, a feedback transistor 24 and a resistor divider. The resistor divider is composed of resistors 26 and 28 which provide feedback to the second input of the comparator 20.

The output of the preregulator is a relatively constant voltage at node 30 equal to the desired regulated output voltage $V_{OUT}$ plus the threshold voltage $V_t$. The threshold voltage $V_t$ is measured between the control lead 16 of the regulating transistor 18 and the output to the load 10. Typically the regulating transistor 18 will be an NMOS transistor operated in the weak inversion mode. A gate capacitor $C_g$ 32 is used to filter voltage fluctuations resulting from oscillator/pump 22.

In order to provide the necessary smoothing of the voltage at control lead 16, capacitor $C_g$ must be relatively large. It is typically on the order of four nanofarads or more. Because the regulated output voltage at the load 10 is equal to the output voltage of the preregulator 14 at node 30 minus the threshold voltage $V_t$, it is critical that gate capacitor $C_g$ be large enough.

However, even if the voltage at the control lead 16 is held absolutely constant, fluctuations in the threshold voltage $V_t$ of the regulating transistor 18 will appear as a change in the regulated output voltage $V_{OUT}$. Unfortunately, for a transistor operating in the weak inversion mode, $V_t$ will vary as a function of the amount of current flowing through the transistor.

Figure 2:
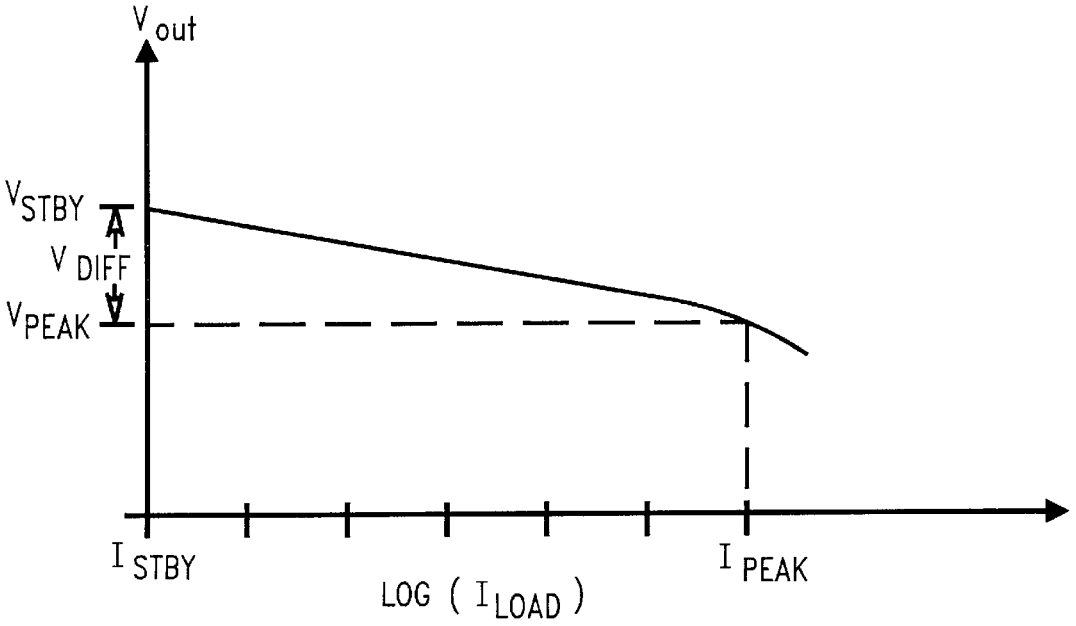
FIG. 2 (Prior Art)
FIG. 2 is a graph illustrating the fluctuation in output voltage as a function of load current $I_{LOAD}$. The graph is drawn on a logarithmic scale.

FIG. 2 shows how the output voltage $V_{OUT}$ varies with load current as a result of these variations in threshold voltage. When the regulating transistor 18 is operating at the low standby current $I_{STBY}$, the output voltage will be $V_{STBY}$. However, because the threshold voltage $V_t$ increases as a function of load current, the output voltage $V_{OUT}$ decreases with increasing current. Thus, when the peak current $I_{PEAK}$ is drawn at the peak of the load event shown by current curve 12 in FIG. 4, the output voltage of a prior art regulator will have dropped to the value $V_{PEAK}$. The difference between $V_{STBY}$ and $V_{PEAK}$ is $V_{DIFF}$, and this difference is the voltage fluctuation at the regulated output as the load current changes during the load event.

As discussed above, due to the relatively short duration of the load event, a feed back system would need to have nearly infinite bandwidth and gain to properly compensate for this voltage fluctuation. However, because the load current characteristic 12 is known, and further, because the voltage drop characteristic at each supplied load current is also known (as shown in FIG. 2), the feedback or boost voltage which would be provided by such a perfect feedback system can be predicted in advance.

The present invention takes advantage of the ability to approximately predict the necessary boost voltage. With this prediction, a boost driver circuit can be designed which is then triggered by a trigger signal associated with the load event. The boost driver circuit generates the necessary boost voltage and applies it to the control lead 16 exactly as needed to counteract the output voltage drop due to the change in threshold voltage as the load event occurs.

Figure 3:
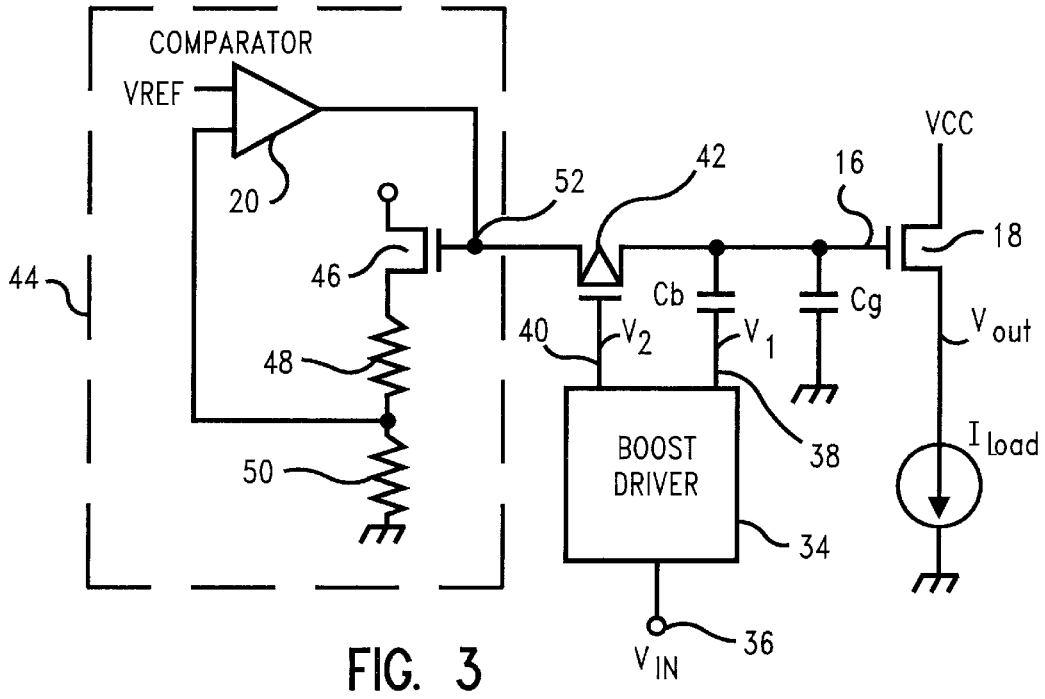
FIG. 3 is a circuit diagram of a voltage regulator according to the present invention.

FIG. 3 provides a circuit diagram, partly in block diagram form, showing a preferred embodiment of the present invention. Boost driver circuit 34 receives a trigger signal $V_{IN}$ at its input 36. Typically the trigger signal $V_{IN}$ will be the sense amp enable signal of the DRAM. It is this signal which initiates the load event causing the increase in load current.

The boost driver circuit 34 includes a first output 38 connected through a first capacitor $C_b$ (boost capacitor) connected to the gate or control lead 16 of the regulating transistor 18. A second output 40 from the boost driver circuit 34 is connected to switch device 42 to disconnect preregulator 44 from the control lead 16 of regulating transistor 18 during application of the boost signal.

In this embodiment of the invention, preregulator 44 comprises a comparator 20, a threshold compensation transistor 46 and a voltage divider composed of resistors 48 and 50. The design of this preregulator provides improved performance as compared to the oscillator/pump preregulator 14 of FIG. 1.

The output voltage of preregulator 44 at node 52 is adjusted to be equal to the desired regulated output voltage $V_{OUT}$ plus the threshold voltage $V_t$ measured during standby conditions, i.e., with current $I_{STBY}$ flowing. At the start of the load event, the load event trigger signal will trigger boost driver circuit 34 through input 36. The boost driver circuit 34 will then generate the necessary shaped boost signal $V_1$ at the first output 38. The boost signal $V_1$ will have an appropriate shape necessary to increase the input voltage at the control lead 16 just enough to counteract the drop in output $V_{OUT}$ during the load event resulting from the known voltage drop characteristic of regulating transistor 18 seen in FIG. 2.

Although the method works best where the load current during the load event is exactly known (as shown in curve 12 of FIG. 4), the method may also be used where the exact details of the load event are only approximately known. In this case, the drop in output voltage may be only partially compensated, but improved performance relative to the prior art is still possible.

Output voltage $V_1$ is fed through the first capacitor $C_b$ which forms a capacitive voltage divider with capacitor $C_g$. Typically the first capacitor $C_b$ will have a capacitance that is significantly less than the capacitance of the second capacitor $C_g$. The capacitive ratio of $C_b$ to $C_g$ will typically fall within the range of 1:100 to 1: 2, and most preferably in the vicinity of 1:10.

Also, because the design of the preregulator is improved, the larger capacitor, $C_g$ will still have a capacitance that is less than the capacitance of the corresponding capacitor $C_g$ in the prior art design of FIG. 1. The capacitance $C_g$ in the preferred embodiment of the present invention is 300 picofarads and the capacitance of $C_b$ is in the vicinity of 30 picofarads.

The boost voltage produced by boost driver 34 is applied for a relatively short duration corresponding to the duration of the load event. During this period the switch device 42, which is preferably a PMOS switch device, is driven by the second output 40 with voltage $V_2$ to disconnect the preregulator 44 from the control lead 16. This prevents loss of charge from $C_g$.

Figure 4:
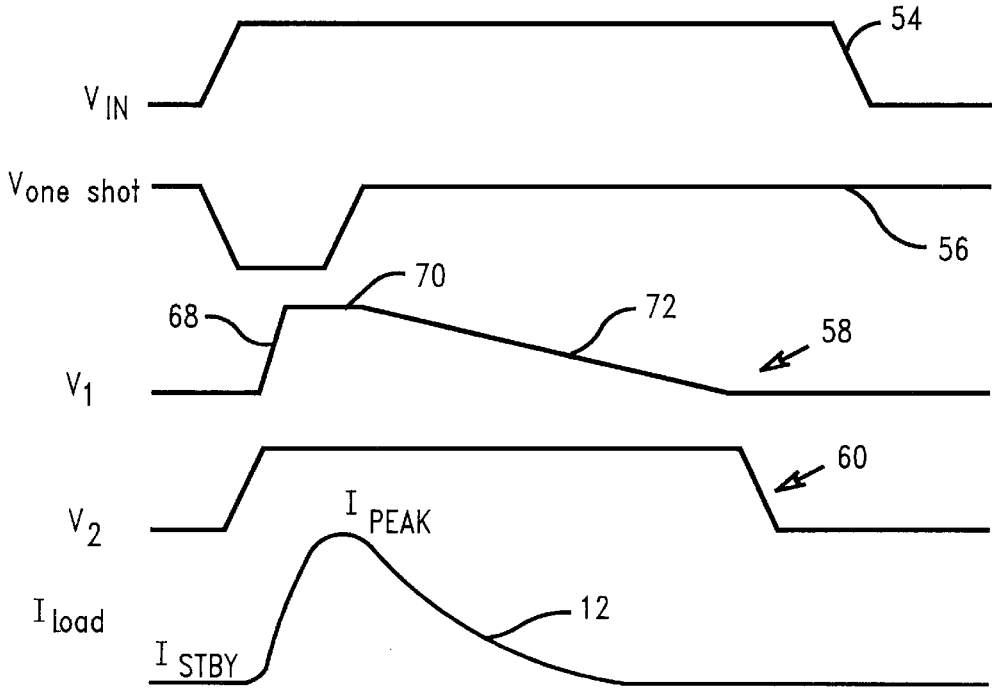
FIG. 4 indicates voltages plotted against time which occur at various points in the voltage regulator of the present invention.
Figure 5:
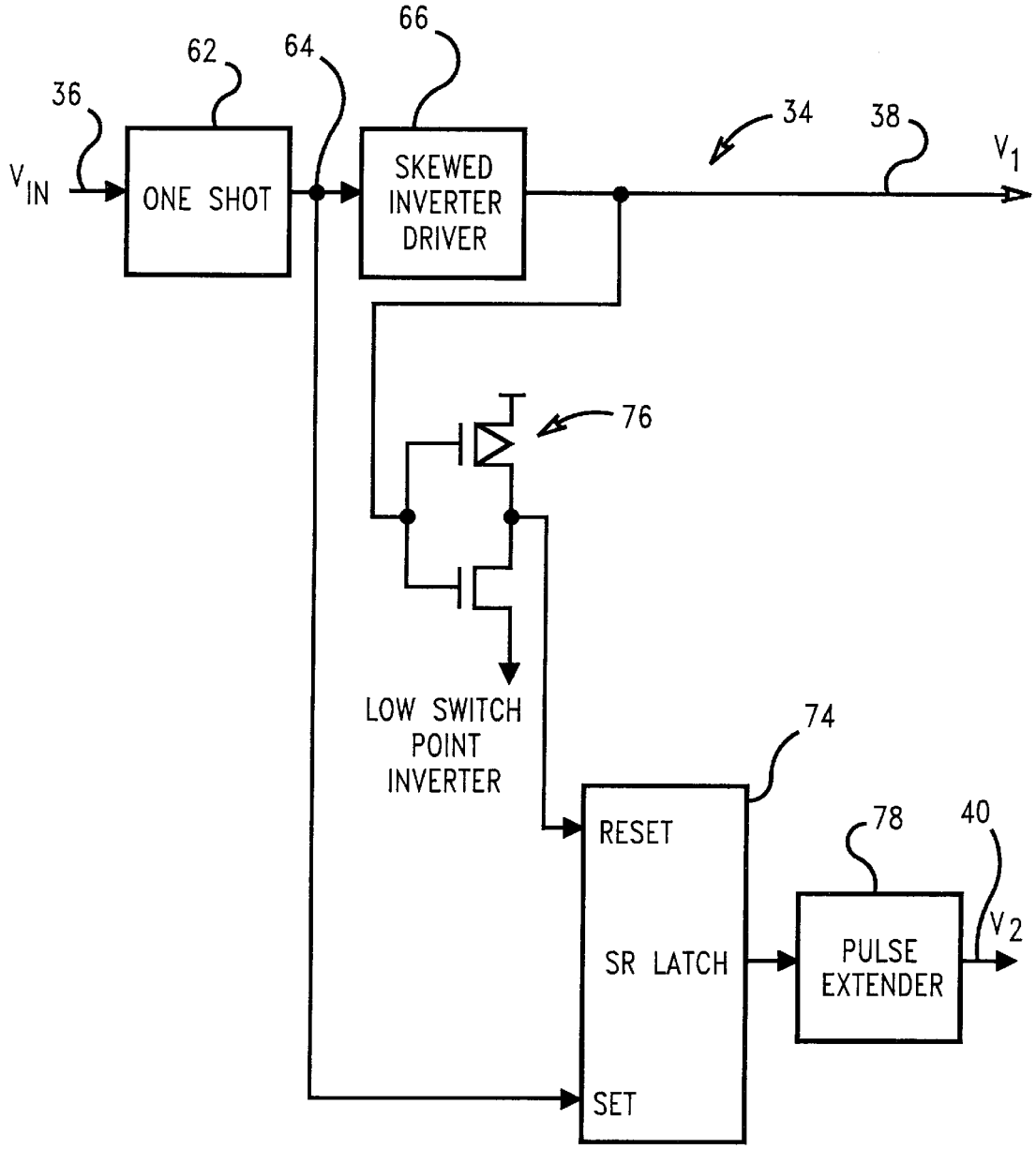
FIG. 5 is a detailed circuit diagram of the boost driver circuit shown in block diagram form in FIG. 3.

FIG. 4 provides a graph of various voltages as a function of time at relevant points in the circuit of FIG. 3. The trigger voltage $V_{IN}$ is indicated with reference numeral 54. The trigger voltage $V_{IN}$ triggers a one shot circuit in the boost driver circuit 34 (to be described later). The one shot voltage, indicated by curve 56, is processed to produce voltage $V_1$ at output 38 and voltage $V_2$ at output 40 of the boost driver circuit. These voltages are indicated by reference numerals 58, 60 respectively. The shape of the boost signal $V_1$ is predetermined according to the approximately known load current characteristic of the load (indicated by reference numerals 12) and by the known voltage drop characteristic of the regulating transistor (seen in FIG. 2).

Both the shape and timing of the boost voltage $V_1$ and switch voltage $V_2$ are carefully adjusted and shaped for minimum disturbance of the output voltage. This is achieved through the use of the boost driver circuit seen in FIG. 5 whose operation is now described.

The trigger signal $V_{IN}$, which triggers the load event, is supplied at input 36 to a conventional one shot circuit 62 shown in block diagram form. The output from the one shot at node 64 is shown in FIG. 4 with curve 56. The duration of the one shot voltage drop seen in FIG. 4 approximately corresponds to the duration of the load event.

The voltage from the one shot is inverted and shaped by a pulse shaping circuit 66 to provide voltage $V_1$. The pulse shaping circuit is most easily provided through the use of a conventional skewed inverted driver. The term "skewed inverter" refers to the differential or skewed sizing of the inverter elements. The characteristics of a skewed inverter driver are such that the inverter has a fast transition on one edge and a comparatively slow transition on the other.

Thus, the symmetrical shape of the one shot pulse 56 becomes the shaped pulse $V_1$ in curve 58 of FIG. 4. More specifically, $V_1$ rises relatively quickly from a low voltage as seen in a segment 68 of curve 58. During the on time of the one shot, the skewed inverter driver is also on as indicated by curve segment 70. The skewed sizing of driver 66 then causes a relatively slow turn off during segment 72.

This boost signal is applied to output 38 of the boost driver circuit 34, and from there to the control lead of the regulating transistor through the capacitive voltage divider to appropriately adjust the output voltage during the load event.

Curve 60 in FIG. 4 illustrates the control signal $V_2$ which is used to turn off switch device 42 during the load event. In the preferred design of FIG. 5, the switching is accomplished by a set reset latch 74 where the set input is connected to the one shot at node 64 and the reset input is connected through a low switch point inverter 76 to the output of the skewed inverter driver 66.

Inverter 76 is designed with a very low threshold voltage, i.e. a low switch point, so that it accurately resets SR latch 74 just as the boost signal $V_1$ drops back to its standby level. This insures that the switch device 42 will be accurately switched at the correct time, and with little or no voltage differential across the switch device 42. This prevents any sudden voltage fluctuations at the control lead 16 which would appear at the regulated voltage output.

The output of SR latch 74 is passed through pulse extender 78 and on to output 40. Pulse extender 78 provides any necessary delay for proper timing of the switching.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A voltage regulator for supplying load current during a load event to a load having an approximately known load current characteristic during the load event, the voltage regulator comprising:

a voltage supply terminal for connection to a supply voltage;

a regulating transistor for supplying the load current during the load event from the voltage supply terminal to the load, the regulating transistor having a control lead, an output for supplying the load current at a regulated voltage and a known voltage drop characteristic for supplied load currents;

a preregulator for supplying a constant voltage to the control lead of the regulating transistor;

a boost driver circuit having an input and an output, the input being connected to receive a trigger signal associated with the load event, the output being connected between the preregulator and the control lead of the regulating transistor, the boost driver circuit being responsive to the trigger signal to produce a shaped boost signal at the boost driver circuit output, the shape of the boost signal being predetermined according to the approximately known load current characteristic of the load and the known voltage drop characteristic of the regulating transistor to adjust the voltage at the control lead of the regulating transistor to compensate for any voltage change at the regulated voltage output of the regulating transistor during the load event.

2. A voltage regulator for supplying load current during a load event according to claim 1 further comprising:

a switch device having a control lead, the switch device being serially connected between the preregulator and the control lead of the regulating transistor; and a second output for the boost driver circuit, the second output being connected to the control lead of the switch device;

the boost driver circuit being responsive to the trigger signal to turn off the switch device via the second output and disconnect the preregulator from the control lead of the regulating transistor during at least a portion of the load event.

3. A voltage regulator for supplying load current during a load event according to claim 2 wherein the boost driver circuit includes a one shot circuit triggered by the trigger signal, the one shot circuit being connected to provide the shaped boost signal at the first output of the boost driver circuit and to turn off the switch device via the second output of the boost driver circuit.

4. A voltage regulator for supplying load current during a load event according to claim 3 wherein the boost driver circuit further includes a pulse shaping circuit connected between the one shot circuit and the first output to shape the boost signal provided at the first output of the boost driver circuit.

5. A voltage regulator for supplying load current during a load event according to claim 4 wherein the pulse shaping circuit comprises a skewed inverter serially connected between the one shot circuit and the first output of the boost driver circuit.

6. A voltage regulator for supplying load current during a load event according to claim 4 wherein the boost driver circuit further includes a set reset latch connected between the one shot and the second output to turn off the switch device.

7. A voltage regulator for supplying load current during a load event according to claim 6 wherein the set reset latch has a set input connected to the one shot circuit and a reset input connected to the pulse shaping circuit.

8. A voltage regulator for supplying load current during a load event according to claim 7 wherein the boost driver circuit further includes a low switch point inverter serially connected between the pulse shaping circuit and the reset input of the set reset latch.

9. A voltage regulator for supplying load current during a load event according to claim 1 further including:

a first capacitor serially connected between the output of the boost driver circuit and the control lead of the regulating transistor; and a second capacitor connected to the control lead of the regulating transistor, the first and second capacitors forming a capacitive divider for delivering the shaped boost signal to the control lead of the regulating transistor.

10. A voltage regulator for supplying load current during a load event according to claim 9 wherein the first capacitor has a lower capacitance than the capacitance of the second capacitor.

11. A voltage regulator for supplying load current during a load event according to claim 10 wherein the first capacitor has a capacitance between 0.01 and 0.5 times the capacitance of the second capacitor.

12. A voltage regulator for supplying load current during a load event according to claim 1 wherein the regulating transistor is an NMOS transistor operated in the weak inversion mode.

13. A voltage regulator for supplying load current during a load event according to claim 1 wherein the approximately known load current characteristic during the load event comprises a rise in current from an initial standby current level to a peak current level, followed by a drop back to the standby current level, the rise and fall in current due to the load event occurring over a known duration and wherein the shaped boost signal comprises a rise from an initial low voltage level followed by a drop back to the initial low voltage level, the duration of the shaped boost signal approximately corresponding to the duration of the load event.

14. A voltage regulator for supplying load current during a load event according to claim 1 wherein the load current characteristic during the load event is a current pulse and the boost driver circuit includes a one shot circuit to produce a pulse at the output of the boost driver circuit.

15. A voltage regulator for supplying load current during a load event according to claim 14 wherein the boost driver circuit further includes a pulse shaping circuit connected between the one shot circuit and the output to shape the boost signal provided at the output of the boost driver circuit.

16. A voltage regulator for supplying load current during a load event according to claim 15 wherein the pulse shaping circuit is a skewed inverter serially connected between the one shot circuit and the output.

17. A voltage regulator for supplying load current during a load event to a load having an approximately known load current characteristic during the load event, the voltage regulator comprising:

a voltage supply terminal for connection to a supply voltage;

an NMOS transistor operating in the weak inversion mode for supplying the load current during the load event from the voltage supply terminal to the load, the NMOS transistor having a control lead, an output for supplying the load current at a regulated voltage and a known voltage drop characteristic for supplied load currents;

a preregulator for supplying a constant voltage to the control lead of the NMOS transistor;

a switch device having a control lead, the switch device being connected between the preregulator and the control lead of the NMOS transistor;

a boost driver circuit having an input, a first output and a second output, the input being connected to receive a trigger signal associated with the load event, the first output being connected to the control lead of the switch device and the second output being connected to the control lead of the NMOS transistor, the boost driver circuit being responsive to the trigger signal to turn off the switch device and disconnect the preregulator from the control lead of the NMOS transistor during at least a portion of the load event and the second output providing a shaped boost signal, the shape of the boost signal being predetermined by the known load current characteristic and the known voltage drop characteristic to compensate for any voltage change at the regulated voltage output of the NMOS transistor during the load event.

18. A voltage regulator for supplying load current during a load event according to claim 17 further including:

a first capacitor serially connected between the first output of the boost driver circuit and the control lead of the NMOS transistor; and a second capacitor connected to the control lead of the NMOS transistor, the first and second capacitors forming a capacitive divider for delivering the shaped boost signal to the control lead of the NMOS transistor.

19. A voltage regulator for supplying load current during a load event according to claim 18 wherein the first capacitor has a lower capacitance than the capacitance of the second capacitor.

20. A voltage regulator for supplying load current during a load event according to claim 19 wherein the shaped boost signal comprises a rise from an initial low voltage level followed by a drop back to the initial low voltage level.

* * * * *